US006866055B2

(12) United States Patent
Scherer

(10) Patent No.: US 6,866,055 B2
(45) Date of Patent: Mar. 15, 2005

(54) TENT WITH TRUSS SYSTEM

(75) Inventor: Michael Scherer, Boulder, CO (US)

(73) Assignee: American Recreation Products, Inc., St. Louis, MO (US)

( * ) Notice: Subject to any disclaimer, the term of this patent is extended or adjusted under 35 U.S.C. 154(b) by 28 days.

(21) Appl. No.: 10/439,281

(22) Filed: May 15, 2003

(65) Prior Publication Data

US 2004/0226224 A1 Nov. 18, 2004

(51) Int. Cl.[7] ..... E04H 15/40; E04H 15/42; E04H 15/54

(52) U.S. Cl. ..... 135/125; 135/115; 135/156; 135/123

(58) Field of Search ..... 135/122–125, 135/156, 115

(56) References Cited

U.S. PATENT DOCUMENTS

| | | | | |
|---|---|---|---|---|
| 3,798,851 A | * | 3/1974 | Utahara | 52/86 |
| 3,909,993 A | | 10/1975 | Huddle | |
| 4,192,333 A | | 3/1980 | Sato | |
| 4,265,260 A | | 5/1981 | Gillis | |
| 4,745,936 A | | 5/1988 | Scherer | |
| 4,750,509 A | * | 6/1988 | Kim | 135/135 |
| 4,966,178 A | * | 10/1990 | Eichhorn | 135/123 |
| 5,080,119 A | | 1/1992 | Scherer | |
| 5,197,505 A | | 3/1993 | Tate | |
| 5,261,436 A | * | 11/1993 | Funk | 135/156 |
| 5,363,626 A | * | 11/1994 | Hanninen | 52/639 |
| 5,421,355 A | * | 6/1995 | Cantwell | 135/120.3 |
| 5,651,633 A | | 7/1997 | Howe | |
| 5,666,986 A | * | 9/1997 | Fox | 135/135 |
| 5,901,727 A | | 5/1999 | Kramer et al. | |
| 6,145,527 A | * | 11/2000 | Gillis | 135/124 |
| 6,227,218 B1 | | 5/2001 | Breaux | |
| 6,415,806 B1 | * | 7/2002 | Gillis | 135/124 |
| 6,470,901 B1 | | 10/2002 | Scherer | |

FOREIGN PATENT DOCUMENTS

EP 000428297 A1 * 5/1991 ..... E04H/15/40

OTHER PUBLICATIONS

Buiding Tents Better, Kelty Tent Owners Manual, Kelty Pack, Inc., Kelty USA, admitted prior art.

Convertible Tents, Kelty Tents Workbook 2000, p. 27, Kelty USA, admitted prior art.

Kelty Tents, Kelty 2003 brochure, Aug. 2002, pp. 39–56, Kelty USA.

Flyboy, Flyboy Tent Instructions and Technology, 2003, p. 7, Kelty USA, admitted prior art.

Kelty X–1 Ultralight Tent color photograph, Jan. 2003, Kelty USA.

Marmot Odyssey Tent photographs, http://www.marmot-.com/products/enlarge.php?style id=C2748, printed Sep. 4, 2003, admitted prior art.

* cited by examiner

*Primary Examiner*—Robert Canfield
(74) *Attorney, Agent, or Firm*—Senniger Powers

(57) ABSTRACT

A tent includes a shell, a frame including at least one flexible, resilient pole for extending over an exterior of the shell in an arch shape and for holding the shell up in an erect configuration in which the shell encloses a living space. The pole includes a plurality of sections, each section bounded by first and second points on the pole. A truss system includes a plurality of chords for tending to hold the pole in the arch shape. Each chord includes at least one tension-taking web extending along the exterior of the shell generally along a line from the first point to the second point of one of the pole sections to inhibit movement of the first and second points away from one another whereby the chords tend to hold the pole in the arch shape and stabilize the tent.

39 Claims, 5 Drawing Sheets

TENT WITH TRUSS SYSTEM

This invention relates to tents, and more particularly to stabilized constructions for tents.

Some prior schemes aimed at stabilizing tents have generally involved utilization of internal trussing, i.e., trussing within the living space of the tent, as for example shown in U.S. Pat. Nos. 5,197,505 and 5,901,727. Such schemes encroach on the living space, and occupants can become entangled with the trussing.

SUMMARY OF THE INVENTION

Among the several objects of the invention may be noted the provision of a tent which is relatively stable and resistant to wind; the provision of such a tent in which structure for stabilizing the tent does not encroach on the living space of the tent; the provision of such a tent which is easy to assemble; the provision of such a tent which is compact when disassembled; and the provision of such a tent which is lightweight.

Briefly, a tent of this invention comprises a shell, a frame comprising at least one flexible, resilient pole extending over an exterior of the shell in an arch shape and holding the shell up in an erect configuration in which the shell encloses a living space. The pole includes a plurality of sections, each section bounded by first and second points on the pole. A truss system comprises a plurality of chords tending to hold the pole in the arch shape. Each chord includes at least one tension-taking web extending along the exterior of the shell generally along a line from the first point to the second point of one of the pole sections to inhibit movement of the first and second points away from one another whereby the chords tend to hold the pole in the arch shape and stabilize the tent.

In another aspect of the invention, the tent comprises a truss system comprising a plurality of flexible, tension-taking webs extending generally from the exterior of the shell to the pole. Adjacent pairs of said webs are attached to the shell and diverge at acute angles with respect to the shell to respective spaced apart points on the pole so as to inhibit movement of the spaced apart points away from one another.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
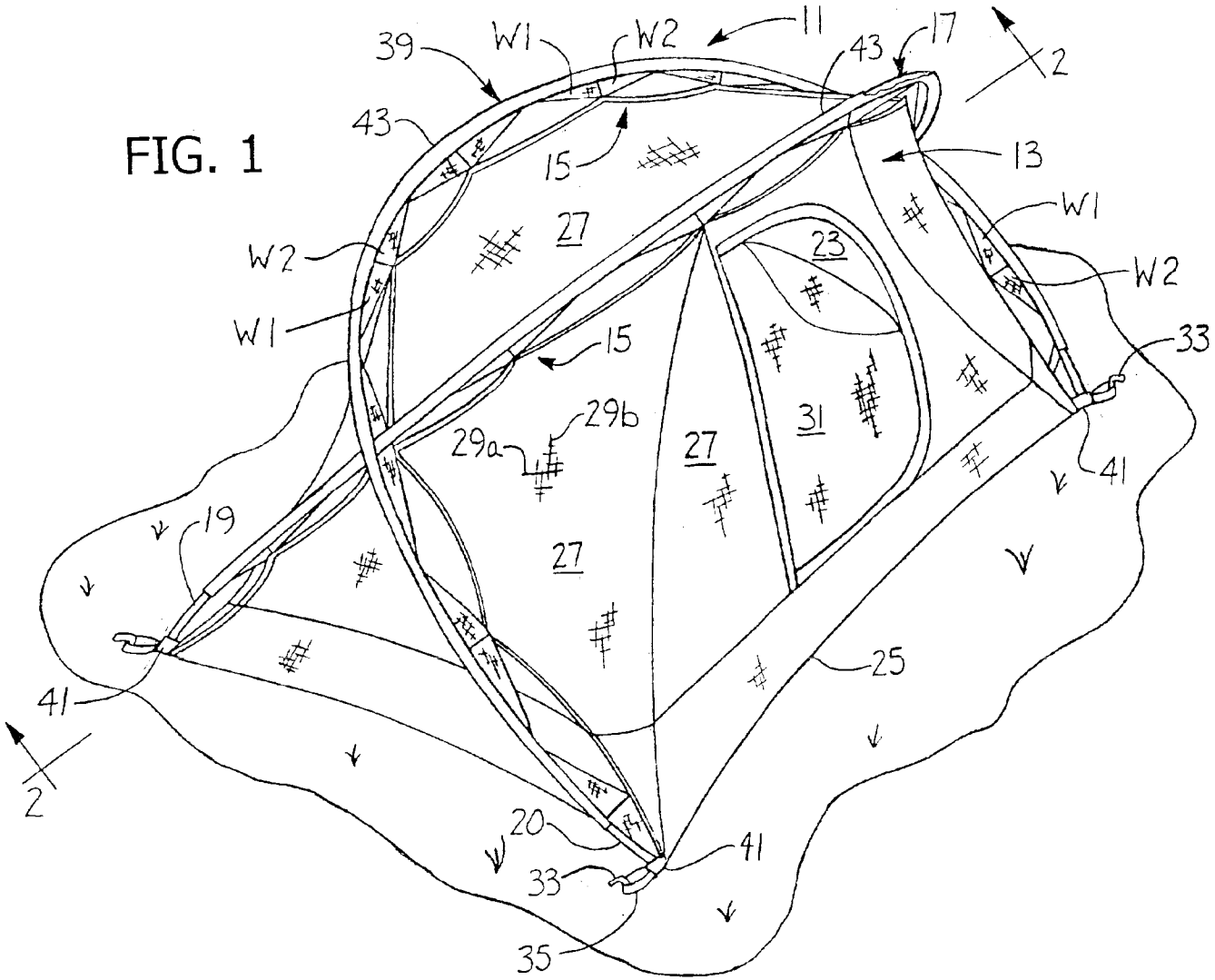
FIG. 1 is a perspective of one embodiment of a tent in accordance with the present invention.

Referring first in particular to FIG. 1 of the drawings, a tent of one embodiment of the invention is generally designated by the numeral 11 and comprises a fabric shell generally designated 13 and two truss systems, each generally designated 15, attached thereto. A frame generally designated 17 comprises a first pole 19 and second pole 20 extending over an exterior of the shell 13 in an arch shape.

The poles hold the shell up in an erect configuration in which the shell encloses a living space 23 sized to accommodate one or more occupants. Each truss system is constructed for tending to hold one of the poles 19, 20 in the arch shape, as will be described in more detail below.

The fabric shell 13 comprises a base 25 and woven fabric panels 27, each panel having parallel warp yarns 29*a* and parallel weft yarns 29*b*, the warp yarns and weft yarns being oriented substantially perpendicular to one another. A door panel 31 is formed in one of the panels 27, and windows (not shown) may also be included in one or more of the panels. The tent 11 is suitably anchored by stakes 33 extending through fabric loops 35 attached to the base 25 of the shell 13. Different types of shells and frames (e.g., frames having three or more poles) are envisioned within the scope of this invention, the tent shown being merely an example of a tent such as may embody this invention.

Each truss system 15 attached to the shell comprises sleeve means generally designated 39 for receiving respective poles 19, 20 in the arch shape. Keepers 41 attached to the base 29 of the shell 13 are disposed at opposite ends of the poles 19, 20 for retaining each pole in the sleeve means. The keepers may suitably include grommets (not shown) for receiving ends of the poles 19, 20. As will be understood, the sleeve means 39 (which are connected to the shell 13 as described below) and the keepers 41 help to inhibit or restrain the poles from bending away from the arch shape. In this embodiment, the sleeve means 39 includes one continuous sleeve 43 for each pole, though the sleeve means may include several separate sleeves within the scope of this invention. The poles 19, 20 extend through the sleeve means 39 and are each bent into the arch shape when the tent is in the erect configuration. The poles 19, 20 are conventional poles circular in cross-section, though other shapes are contemplated. Note that the poles 19, 20 and truss systems 15 are substantially identical in this embodiment, though different types of poles and systems may be used on the same tent within the scope of this invention.

Figure 2:
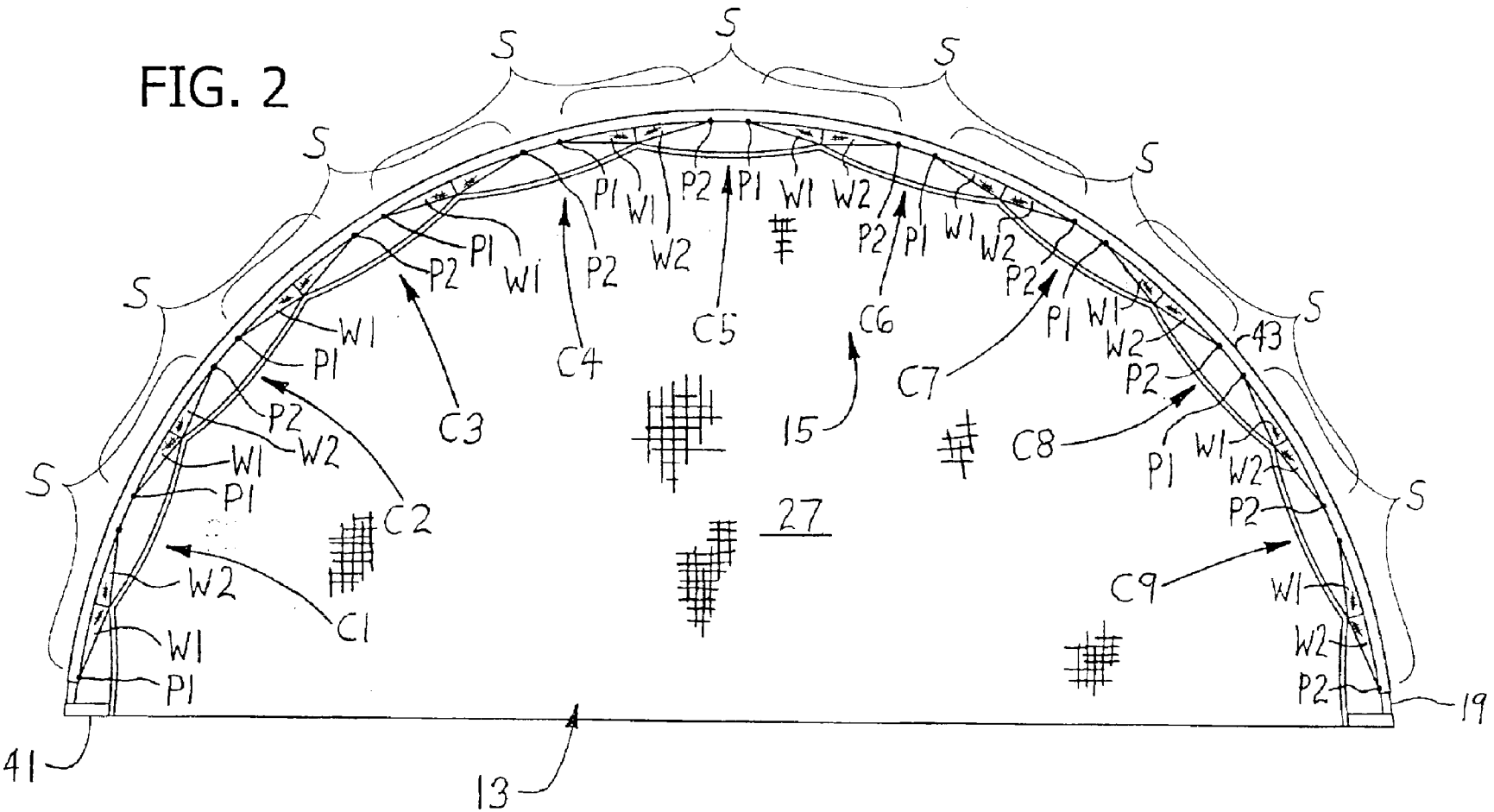
FIG. 2 is a view generally in section on line 2—2 of FIG. 1 showing a truss system in accordance with the invention.
Figure 2A:
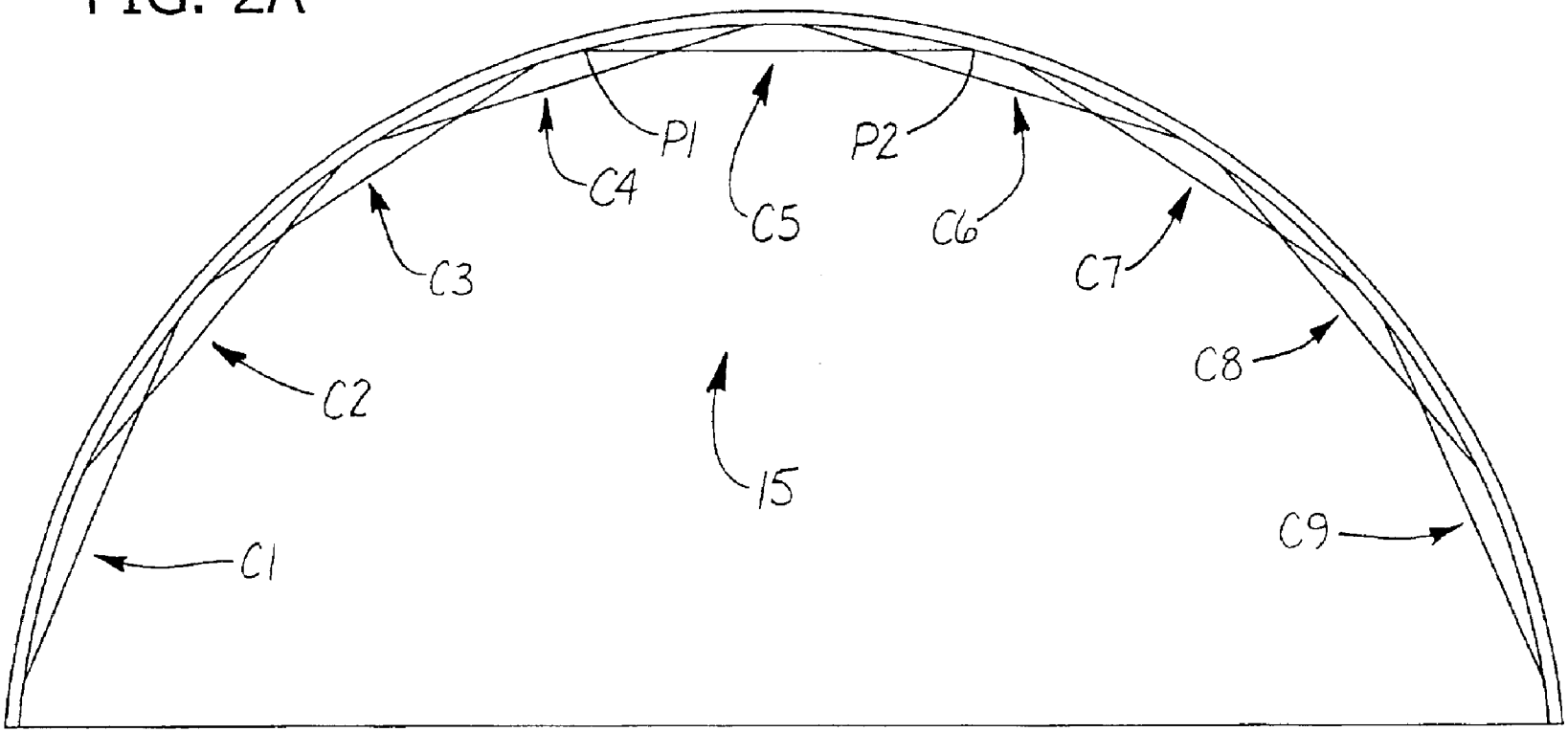
FIG. 2A is a schematic of the truss system of FIG. 2.
Figure 3:
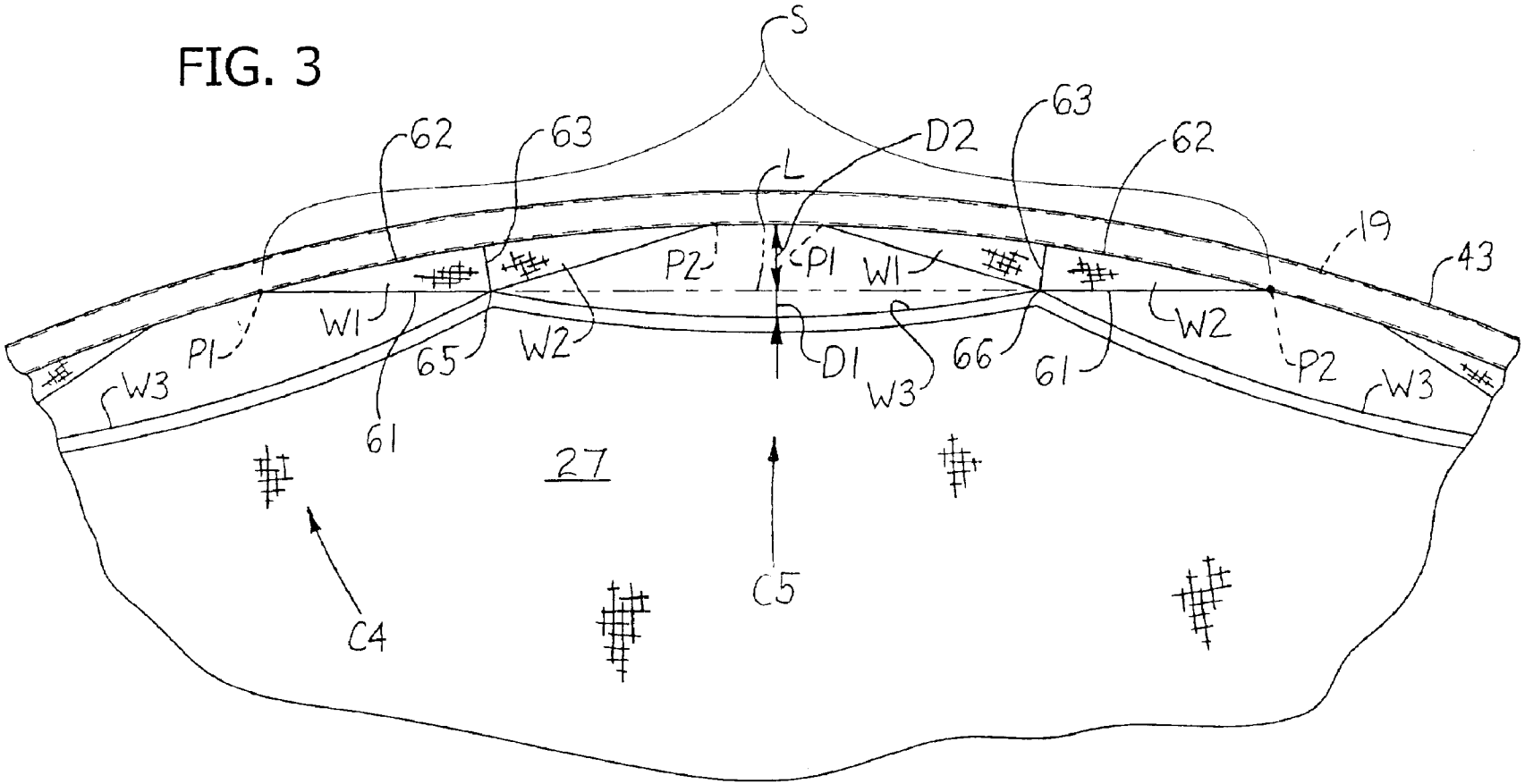
FIG. 3 is an enlarged view of a chord of the truss system of FIG. 2.

Referring to FIGS. 2–3, the pole 19 includes a plurality (e.g., nine as shown) of overlapping sections S, each section bounded by first and second reference points P1, P2. The truss system 15 comprises a corresponding number of chords (numbered C1–C9, respectively), one chord being provided for each section S. Each chord is preferably substantially identically constructed and extends generally along an imaginary line L between respective points P1, P2. (See FIG. 3). A simplified schematic of the system 15 is shown in FIG. 2A to help the reader visualize the system.

An exemplary chord C5 (shown in detail in FIG. 3) includes first and second generally triangular-shaped, tension-taking webs W1, W2, and a third tension-taking web W3 formed of tape or the like attached to one or more of the panels 27 of the shell 13. Each first and second web W1, W2 includes a free side 61 extending generally along the line L, a sleeve side 62 and a web side 63. The free side 61 of the first web W1 extends generally from the first point P1 to an end 65 of the third web W3. Similarly, free side 61 of the second web W2 extends generally from an opposite end 66 of the third web W3 to the second point P2. The free sides 61 are free of attachment except at respective ends, and are adapted to take tension with little or no stretching. The free sides 61 and web W3 preferably deflect only slightly from the line L. As shown in FIG. 3, the web W3 deflects a distance D1 that is no greater than about one inch, and more preferably no greater than about one-half inch.

The respective free sides 61 of the first and second webs W1, W2 have ends (at the web side 63) that are attached, as by sewing, to respective ends 65, 66 of the third web W3. The first and second webs W1, W2 are thereby connected via the third web W3 to the panel 27 of the shell 13. Alternatively, the first and second webs W1, W2 may be attached directly to the panel 27, e.g., if the third web W3 is attached to the interior of the panel 27. The sleeve side 62 of each first and second web W2, W3 is attached, as by sewing, along substantially its full length to the sleeve 43. The webs W1–W3 thereby connect the pole 19 and the panel or panels 27 of the shell 13.

The exemplary chord C5 is overlapped by an adjacent chord C4 (generally to the left of chord C5 in FIG. 3, chord C4 being only partially shown). The first web W1 of the exemplary chord C5 is adjacent to the second web W2 of the adjacent chord C4, the two webs being attached to one another to form a pair of first and second webs. The pair of webs is attached to the end 65 of third web W3 (as noted above), the pair being thereby connected to the panel 27 of the shell 13 at generally the same location. Note that in this embodiment, the end 65 of third web W3 of chord C5 is also the end of the third web W3 of the adjacent chord C4. The web sides 63 of each of the first and second adjacent webs W1, W2 extend side-by-side between the pole and the end 65 of the webs W3. The web sides 63 of the pair of webs W1, W2 are preferably attached to one another substantially along their full lengths.

The free sides 61 of the pair of first and second webs W1, W2 form acute angles Θ with respect to the panel 27. Each acute angle Θ is preferably less than 30°, and more preferably less than 20°. The first web W1 of the central chord C5 extends to the first point P1 of its respective section S of the pole 19, and the second web of the adjacent chord C4 extends to the second point P2 of its section. The pair of webs W1, W2 thereby secure the spaced apart first and second points P1, P2 of adjacent sections on the pole to the same general location or point on or adjacent the panel 27 of the shell 13 so as to further inhibit movement of the points away from one another and to inhibit movement of each point away from the shell. Such an arrangement also tends to hold the pole in the arch shape. Note that the first and second webs W1, W2 may be enlarged so that the end of each free side 61 is closer to, or shares an endpoint with, an adjacent respective second or first web.

The webs W1–W3 are suitably made of flexible materials, such as fabric, cord or tape, which are stretch resistant and capable of taking tension forces, but not compression forces. Such materials are advantageous because, among other reasons, they are more compact for storage, of lighter weight and make the tent easier to assemble than, for example, a rigid pole. Preferably, the chords C1–C9 are substantially free of rigid, non-flexible materials (e.g., there are no rigid clips).

Figure 4:
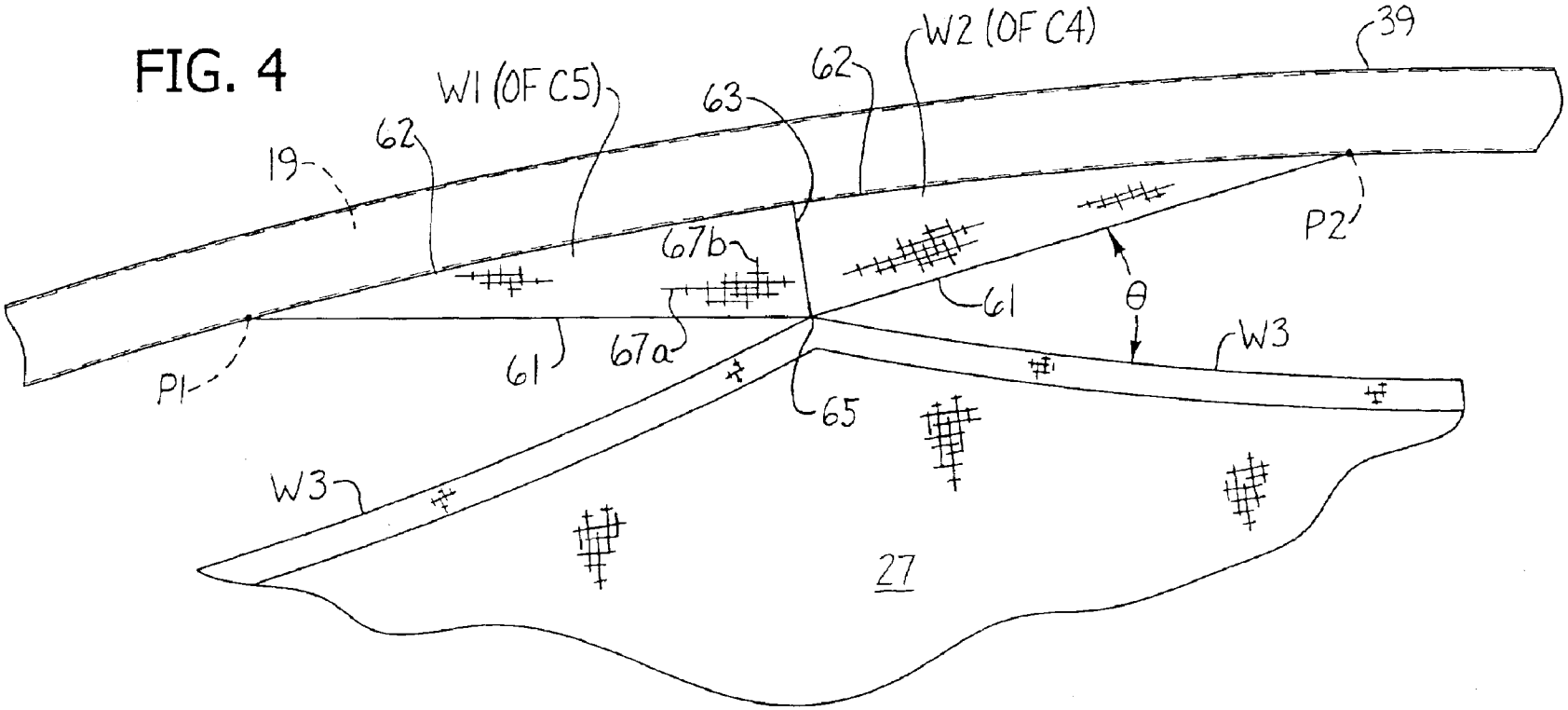
FIG. 4 is an enlarged view of webs of FIG. 3.

As shown in FIG. 4, each first and second web W1, W2 of this embodiment is made of flexible, woven fabric having parallel warp yarns 67*a* and parallel weft yarns 67*b*. The warp yarns and weft yarns are oriented substantially perpendicular to one another. The warp yarns 67*a* extend generally parallel to or along the line L between the points P1 and P2, and the weft yarns 67*b* extend generally perpendicular to the line (though this warp-weft relationship may be reversed within the scope of the invention). When tension force is applied to the webs W1, W2 along or parallel to one of the warp and weft yarns, i.e., along the line L, the webs tend to stretch only slightly because they are stretch resistant, preferably yielding no more than about 2%, and more preferably no more than about 1%, under loading of about 40 pounds. In contrast, when tension force is applied to such fabric at an angle to both the warp and weft yarns, such fabric tends to stretch significantly more.

The third webs W3 are made of a continuous tape that is attached, as by sewing, along its length to panels 27 of the shell 13 beneath each pole 19, 20. Suitable tape materials include carbon fiber and polyethylene (e.g., such as Dyneema™ or Spectra™) among others. The third webs W3 may also be made of flexible woven fabric as described above with the warp or weft yarns disposed along, or parallel to, the line L between the points P1, P2. It is also contemplated that each third web W3 be formed merely by one or more of the fabric panels 27, but in such case it is preferred that the woven fabric of the panels be arranged so that either the warp or weft yarns 29*a*, 29*b* are generally parallel to the line L so that the web is stretch resistant.

In this embodiment, each chord C1–C9 of the truss system 15 is overlapped by at least one other chord to promote a more even distribution of stress in the pole 19, 20. In this embodiment, most chords C1–C9 are overlapped by two adjacent chords (double overlap), the exception being the chords C1 and C9 nearest the base 25 of the tent 11. Alternatively, the system of this invention may be constructed such that some of the chords are overlapped by three or more chords, or less desirably, the truss system may be constructed such that only selected chords or none of the chords overlap. Also, nine chords are shown in this example, but the number of chords may vary depending, for example, on the size and type of pole and the size and type of tension-taking webs forming the chord. Preferably, there are at least four chords associated with each pole.

An ideal length of each chord C1–C9 is generally as long as possible without substantial encroachment on the living space inside the shell, and preferably without any encroachment on the living space. For example, each pole section S has a center midway along its length, and the ideal chord length (length of line L between the first and second points P1, P2 on the pole) is at least about 5 times a minimum distance D2 between the center of the pole section and the line L, more preferably at least about 10 times such distance.

Note that each chord C1–C9 shown herein is of multi-piece construction, i.e., each chord is made of several tension-taking webs. Alternatively, each chord may be made of a single tension-taking member which extends generally between two points on the pole, and the chord or tension-taking member need not necessarily contact the panels 27 of the shell 13. Also, the webs W1, W2 of this embodiment are considered to extend generally to the points P1, P2 and to the panel(s) 27 of the shell 13. There may be some space between ends of the webs W1, W2 and the pole 19 (e.g., if the pole does not fit snugly within the sleeve), and/or between the ends of the webs and the panel(s) 27. In any event, the webs W1–W3 function to take tension generally along the line L between the points P1, P2. Also, the arched pole 19 lies generally in a vertical plane, and the chords C1–C9 extend generally in the plane of the pole. However, some portions of the chords C1–C9 may extend at angles to the plane within the scope of this invention.

The webs W1–W3 of this embodiment are disposed only exterior to the living space 23, though it is contemplated that the webs, or portions thereof, may be disposed on the interior of the panels 27. In such case, the webs are preferably disposed so as to avoid substantial encroachment on the living space 23 inside the shell 13. For example, the third webs W3 may extend along the interior of the panels 27, preferably being attached along substantially their full length to the panel so that the webs do not substantially encroach on the living space 23.

The chords of this invention may also be secured directly to the poles 19, 20, and the sleeve means 39 may be omitted within the scope of this invention. Also, separate means (other than the webs W1–W3) may be used to secure the poles 19, 20 to the panels 27. For example, conventional rigid clips may be attached to the panels and adapted to be clipped over the pole, as is well known in the art. (See, e.g., co-assigned U.S. Pat. Nos. 4,827,958 and 6,470,901, which are incorporated herein by reference.) It is further contemplated within the scope of the invention that the truss systems may be detached or detachable from the shell 13. However, it is preferred for the truss systems to be permanently attached to the shell because such construction facilitates easier assembly of the tent. In other words, no additional steps are required to assemble the truss systems because they are permanently attached to the panels 27 of the shell 13.

Among other advantageous features, each chord C1–C9 functions to take tension generally along the line L, to inhibit movement of the points P1, P2 on the pole away from another, and to inhibit movement of each point away from the shell. The truss system inhibits respective sections S of the poles 19, 20 from reverting from the arch shape into a straight, or possibly inverted, shape in the presence of strong winds. Such straightening or inversion of sections of the pole can cause the pole to fail. The overlapping of the chords serves to ensure that there are no "weak spots" in the pole, e.g., areas of the pole between the chords which are not inhibited from such movement by the chords. The chords also serve to more evenly distribute stress over all sections of the pole. For example, in conventional tents, sections of the poles near the base of the tent 11 are not stressed significantly, even under high winds. With this invention, such sections bear significantly more wind force or stress and thus make the poles and the tent much more stable in the presence of strong winds. Thus, the truss system 15 tends to hold the poles in an arch shape and to stabilize the tent.

It is contemplated that the tent may incorporate many other stabilizing features, including but not limited to those disclosed in co-assigned U.S. Pat. No. 6,470,901, which is incorporated herein by reference. For example, trussing may be provided to stabilize the poles relative to one another.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A tent comprising:

a shell;

a frame comprising at least one flexible, resilient pole extending over an exterior of the shell in an arch shape and holding the shell up in an erect configuration in which the shell encloses a living space, said at least one pole including a plurality of sections, each section bounded by first and second points on the pole; and a truss system comprising a plurality of chords tending to hold the pole in the arch shape;

each chord including at least one tension-taking web extending along the exterior of the shell generally along a line from said first point to said second point of one of said pole sections to inhibit movement of the first and second points away from one another whereby the chords tend to hold the pole in the arch shape and stabilize the tent, each pole section having a center midway along its length, and each cord having a chord length measured between the first and second points on the pole of at least about 5 times a minimum distance between the center of the pole section and the chord.

2. The tent as set forth in claim 1 wherein each chord is constructed of flexible tension-taking webs on the shell for easy tent assembly and for compact tent storage.

3. The tent as set forth in claim 2 wherein each of the webs is attached to the shell.

4. The tent as set forth in claim 1 wherein the frame comprises at least two flexible, resilient poles, and the tent comprises said truss system for each of said poles.

5. The tent as set forth in claim 1 wherein the chord length is at least about 10 times the minimum distance between the center of the pole section and the chord, the chord length being such that no portion of the chord substantially encroaches on the living space inside the shell.

6. The tent as set forth in claim wherein no portion of the chords is inside the living space.

7. A tent comprising:

a shell;

a frame comprising at least one flexible, resilient pole extending over an exterior of the shell in an arch shape and holding the shell up in an erect configuration in which the shell encloses a living space, said at least one pole including a plurality of sections, each section bounded by first and second points on the pole; and a truss system comprising a plurality of chords tending to hold the pole in the arch shape;

each chord including at least one tension-taking web extending along the exterior of the shell generally along a line from said first point to said second point of one of said pole sections to inhibit movement of the first and second points away from one another whereby the chords tend to hold the pole in the arch shape and stabilize the tent, the tension-taking web being made of flexible woven fabric having parallel warp yarns and parallel weft yarns, the warp yarns and weft yarns being oriented substantially perpendicular to one another, one of the warp and weft yarns extending generally parallel to the line between said first and second points.

8. The tent as set forth in claim 7 wherein each of the webs is attached to the shell.

9. The tent as set forth in claim 7 wherein no portion of the chords is inside the living space.

10. The tent as set forth in claim 7 wherein the frame comprises at least two flexible, resilient poles, and the tent comprises said truss system for each of said poles.

11. A tent comprising:

a shell:

a frame comprising at least one flexible, resilient pole extending over an exterior of the shell in an arch shape and holding the shell up in an erect configuration in which the shell encloses a living space, said at least one pole including a plurality of sections, each section bounded by first and second points on the pole; and a truss system comprising a plurality of chords tending to hold the pole in the arch shape;

each chord including at least one tension-taking web extending along the exterior of the shell generally along a line from said first point to said second point of one of said pole sections to inhibit movement of the first and second points away from one another whereby the chords tend to hold the pole in the arch shape and stabilize the tent, a first of the chords overlapping a second of the chords disposed adjacent to the first chord.

12. The tent as set forth in claim 11 wherein each chord overlaps at least one adjacent chord to promote even distribution of stress in the pole.

13. The tent as set forth in claim 12 wherein the truss system includes at least four chords.

14. The tent as set forth in claim 11 wherein each chord includes a first tension-taking web extending generally from the first point on the pole to the shell and a second tension-taking web extending generally from the shell to the second point on the pole, the webs extending along the line between the first and second points.

15. The tent as set forth in claim 14 wherein the truss system includes sleeve means for receiving the pole in the arch shape.

16. The tent as set forth in claim 15 wherein the first and second tension-taking webs are attached to and extend from the sleeve.

17. The tent as set forth in claim 16 wherein the first and second tension-taking webs are made of triangular-shaped woven fabric having parallel warp yarns and parallel weft yarns, the warp yarns and weft yarns being oriented substantially perpendicular to one another, one of the warp and weft yarns extending generally parallel to the line between said first and second points.

18. The tent as set forth in claim 17 wherein the first web of the first chord is attached to an adjacent second web of the adjacent chord.

19. The tent as set forth in claim 18 wherein the first web of the first chord and the second web of the adjacent chord are attached to one another and connected to the shell at substantially the same location.

20. The tent as set forth in claim 19 wherein respective first sides of the first and second webs are substantially free of attachment except at respective ends thereof, the first sides lying along the line between the first and second points.

21. The tent as set forth in claim 20 wherein a second side of each web is attached to the sleeve and a third side of the first web is attached to a third side of the adjacent second web of the adjacent chord.

22. The tent as set forth in claim 19 wherein the first and second webs extend from the shell at angles relative to the shell of less than about 30 degrees.

23. The tent as set forth in claim 14 wherein the first and second webs are connected to opposite ends of a third tension-taking web attached to the shell.

24. The tent as set forth in claim 23 wherein the first, second and third webs deflect no more than one-half inch from the line between the first and second points.

25. The tent as set forth in claim 24 wherein the first chord overlaps an adjacent chord.

26. The tent as set forth in claim 11 wherein the frame comprises at least two flexible, resilient poles, and the tent comprises said truss system for each of said poles.

27. A tent comprising:

a shell;

a frame comprising at least one flexible, resilient pole extending over an exterior of the shell in an arch shape and holding the shell up in an erect configuration in which the shell encloses a living space, said at least one pole including a plurality of sections, each section bounded by first and second points on the pole; and a truss system comprising a plurality of chords tending to hold the pole in the arch shape;

each chord including at least one tension-taking web extending along the exterior of the shell generally alone a line from said first point to said second point of one of said pole sections to inhibit movement of the first and second points away from one another whereby the chords tend to hold the pole in the arch shape and stabilize the tent, said at least one web being constructed to stretch no more than about 2% when a force of about 40 pounds is applied along the line between said first and second points.

28. The tent as set forth in claim 27 wherein each chord is constructed of flexible tension-taking webs on the shell for easy tent assembly and for compact tent storage.

29. The tent as set forth in claim 27 wherein each of the webs is attached to the shell.

30. The tent as set forth in claim 27 wherein no portion of the chords is inside the living space.

31. The tent as set forth in claim 27 wherein each chord overlaps at least one adjacent chord to promote even distribution of stress in the pole.

32. The tent as set forth in claim 31 wherein the truss system includes at least four chords.

33. The tent as set forth in claim 27 wherein the frame comprises at least two flexible, resilient poles, and the tent comprises said truss system for each of said poles.

34. A tent comprising:

a shell;

a frame comprising at least one flexible, resilient pole extending over an exterior of the shell in an arch shape and holding the shell up in an erect configuration in which the shell encloses a living space; and a truss system on the shell tending to hold the pole in the arch shape, the truss system comprising a plurality of flexible, tension-taking webs extending generally from the exterior of the shell toward the pole, adjacent pairs of said webs being connected to the shell and diverging at acute angles with respect to the shell toward respective spaced apart points on the pole so as to inhibit movement of the spaced apart points away from the shell, each adjacent pair of webs being connected to the shell at substantially the same location.

35. The tent as set forth in claim 34 wherein each of said webs forms an acute angle with the exterior of the shell of less than about 30 degrees.

36. The tent as set forth in claim 35 wherein there are at least four pairs of said webs.

37. The tent as set forth in claim 34 wherein each of the webs is attached to the shell.

38. The tent as set forth in claim 34 wherein no portion of the webs is inside the living space.

39. The tent as set forth in claim 34 wherein the frame comprises at least two flexible, resilient poles, and the tent comprises said truss system for each of said poles.

* * * * *

UNITED STATES PATENT AND TRADEMARK OFFICE

CERTIFICATE OF CORRECTION

PATENT NO. : 6,866,055 B2
DATED : March 15, 2005
INVENTOR(S) : Michael Scherer

It is certified that error appears in the above-identified patent and that said Letters Patent is hereby corrected as shown below:

Column 8,
Lines 10-11, “alone a” should read -- along a --.

Signed and Sealed this

Twelfth Day of July, 2005

JON W. DUDAS
*Director of the United States Patent and Trademark Office*